United States Patent [19]

Martini

[11] 3,964,491

[45] June 22, 1976

[54] BRASSIERE CONSTRUCTION

[75] Inventor: George Martini, Brooklyn, N.Y.

[73] Assignee: Glamorise Foundations, Inc., New York, N.Y.

[22] Filed: Aug. 16, 1974

[21] Appl. No.: 498,237

Related U.S. Application Data

[63] Continuation-in-part of Ser. No. 345,967, March 29, 1973, abandoned.

[52] U.S. Cl. ..... 128/476

[51] Int. Cl.[2] ..... A41C 3/10

[58] Field of Search ..... 128/476, 494, 477, 465

[56] References Cited

UNITED STATES PATENTS

| | | | |
|---|---|---|---|
| 2,967,527 | 1/1961 | Maas | 128/476 X |
| 2,971,514 | 2/1961 | Steinmetz | 128/494 |
| 2,973,764 | 3/1961 | Steiner | 128/476 |

*Primary Examiner*—H. Hampton Hunter

*Attorney, Agent, or Firm*—Larson, Taylor & Hinds

[57] ABSTRACT

A brassiere is disclosed which has a pair of side sections stitched to opposite side edges of a front section. The front section consists of an outer panel provided in its upper portion with a pair of semi-circular recesses. An elastic inner panel underlies the upper portion of the outer panel and is stitched thereto along the side edges and along its lower edge in downwardly spaced relation from the recesses. A pair of breast cups are provided on the inner panel, and lower portions of the cups project forwardly through the recesses in the outer panel, while crescent-shaped pockets exist between the two panels around the lower cup portions. The attachment of the breast cups to an elastic inner panel allows the breast cups to move with the breasts relative to the rib cage, independent of the outer garment. A pair of semi-circular reinforcing wires are embedded in the edges of the recesses in the outer panel. The wires are rigid with respect to the outer panel (being fixed in the plane of the outer panel) and the breast cups are in free-floating relationship with respect to the wires.

3 Claims, 4 Drawing Figures

BRASSIERE CONSTRUCTION

CROSS REFERENCE TO RELATED APPLICATION

This is a continuation-in-part of application Ser. No. 345,967 filed Mar. 29, 1973, now abandoned.

This invention relates to new and useful improvements in the construction of brassieres. More specifically, the invention is concerned with the construction of a brassiere front section which includes an arrangement of the breast cups and reinforcing wires where the reinforcing wires are rigid with respect to the outer panel of the brassiere and the breast cups are in a free floating relationship with respect to the reinforcing wires, the breast cups being attached to a resilient underpanel. With this arrangement lateral and vertical movement of the breast cups with the breasts, independent of the outer panel, is allowed.

Heretofore, in an effort to provide support and yet afford freedom-of-movement without dislocating the brassiere relative to the body, brassieres have been proposed wherein the cups, once fitted over the breast, remain in a fixed position because of the attachment thereof to an inner panel next to the skin. An example of such a brassiere is disclosed in U.S. Pat. No. 2,967,527. The under-lying support wires are able to move laterally with respect to the cups as a result of the flexible manner, e.g. by faggoting, in which the wires are secured to an outer panel. Similarly, in an attempt to achieve even greater relative movement, brassieres have been proposed, such as that disclosed in U.S. Pat. No. 2,973,764, which attempt to move the entire outer panel relative to the fixed position of the cups attached to an inner panel. While these brassieres, and others of similar design, have provided some relief from the dislocation or "riding up" of the brassiere caused by body motion, they have not succeeded in imparting the degree of freedom-of-motion desired by the wearer because they fail to accommodate the natural movement of the breasts relative to the rib cage.

Accordingly, the principal object of the invention is to provide an improved brassiere construction which accommodates breast movement relative to the rib cage without sacrificing the increased support achieved by the presence of underlying wires. In accordance with the invention an improved brassiere front section is provided which includes an outer panel having a pair of substantially semi-circular recesses formed in an upper portion thereof; a pair of semi-circular reinforcing wires embedded in the edges of recesses of the outer panel in a manner which prevents movement of the wires out of the plane of the outer panel; and an elastic inner panel which underlies the outer panel, the inner panel being provided with a pair of breast cups having their lower portions projecting forwardly through the recesses in the outer panel. The inner panel is attached by stitching to the outer panel at the uppermost point between the breast cups, and along the side and lower edges of the inner panel, so that substantially crescent-shaped pockets exist between the two panels around the lower portions of the cups. This results in the outer panel, including the wire associated therewith, being fixed relative to the underlying skin of the wearer. However, space afforded by the crescent shaped pockets attached to the elastic inner panel enable the cups to move freely with the breasts without disturbing the outer underbust support provided by the reinforcing wires. As the breasts move relative to the rib cage, the elastic inner panel stretches horizontally and/or vertically allowing the cups to move without any dislocation or "riding up" of the outer panel of the brassiere relative to the skin of the wearer.

The improved construction provided by the invention is applicable to brassieres of the bandeaux as well as of the longline type, and also to the brassiere portion of corselets or similar garments.

With the foregoing more important objects and features in view, and such other objects and features which will become apparent as this specification proceeds, the invention will now be described in conjunction with the accompanying drawings, in which like reference characters designate like parts throughout the drawings, and in which.

Figure 1:
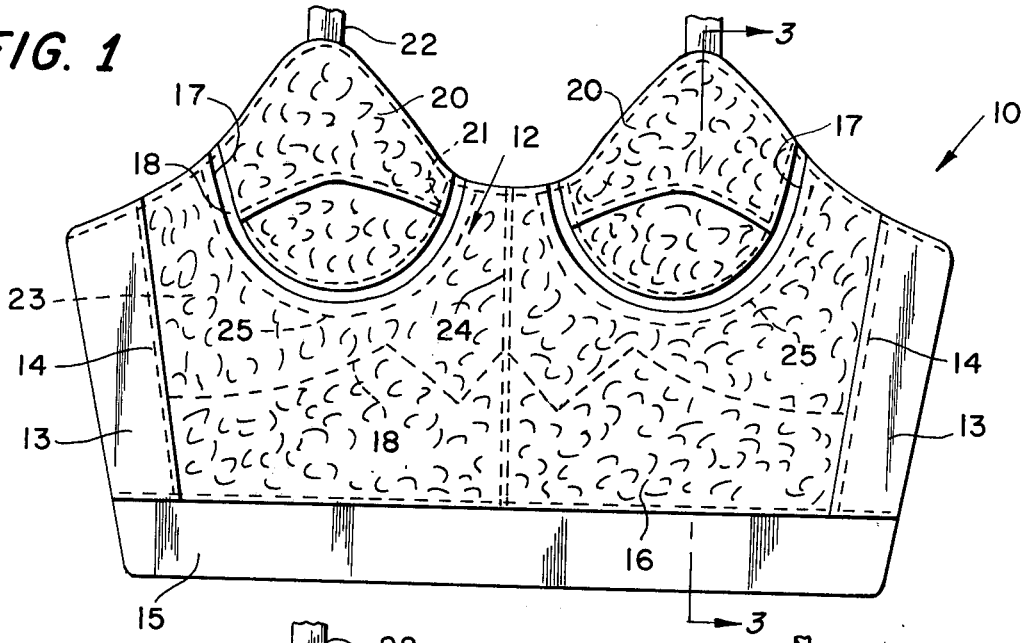
FIG. 1 is a front elevational view of a brassiere embodying the improved front section of the invention.

Referring now to the accompanying drawings in detail, the brassiere of the invention, which is designated generally as 10 in FIG. 1, includes a front section 12 with which the invention is concerned. A pair of side sections 13 are connected to opposite side edges of the front section 12 by lines of stitching 14, the side sections extending around to the back of the garment where they are separably connected together in the conventional well-known manner. If the brassiere is of the bandeaux type or of the so-called longline type, a circumferential band 15 is usually provided at the lower edge thereof. Alternatively, the brassiere may constitute the upper portion of a corselet or similar garment.

Figure 2:
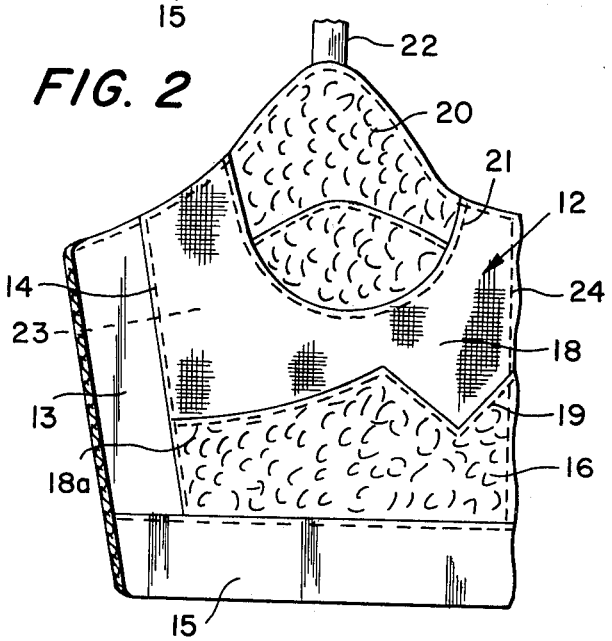
FIG. 2 is a fragmentary front elevational view showing the inside of the front section.

As already noted the invention concerns itself particularly with the construction of the front section 12. This section comprises an outer panel 16 which may consist of Nylon tricot material, the upper portion of the panel 16 being provided with a pair of transversely spaced, substantially semi-circular recesses 17 which are disposed at locations inwardly of the lines of stitching 14. An inner panel 18 underlies the outer panel 16, the two panels 16 and 18 being connected together at their side edges by the stitching 14. The lower edge 18*a* of the inner panel 18 (see FIG. 2) is connected to the outer panel 16 by lower lines of stitching 19, it being noted that the lower edge 18*a* and the stitching 19 are disposed below the recesses 17.

The inner panel 18 is made of a resilient material, preferably an elastomeric material such as elasticized mesh, which is yieldable in both the vertical and lateral directions. A pair of breast cups 20 are provided on the inner panel 18, being connected thereto by stitching 21.

The inner and outer panels are also connected together by a vertical line or lines of stitching 24 located centrally between the breast cups. There is no attachment of the inner and outer panels along line 21. Thus the attachment of the inner panel 18 and the outer panel 16 along the three lines of stitching 14, 19 and 24 creates substantially crescent-shaped pockets around the lower portions of the breast cups 20.

Figure 3:
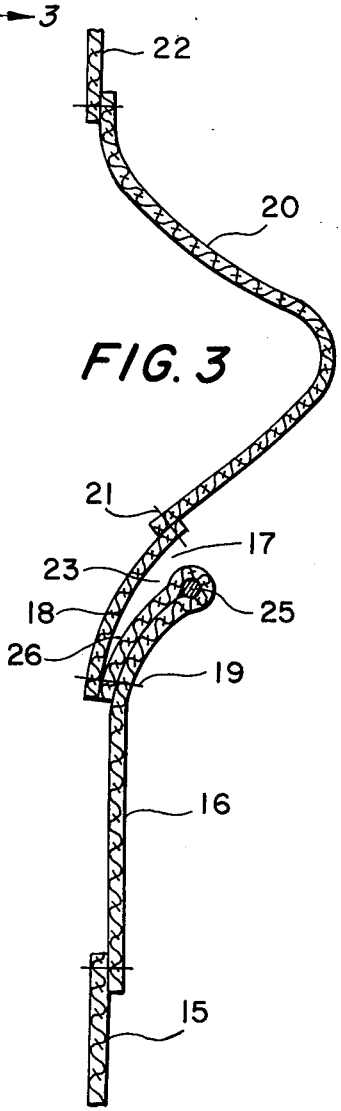
FIG. 3 is an enlarged sectional detail, taken substantially in the plane of the line 3—3 in FIG. 1, with the parts spread apart for sake of clarity of illustration.

Although upper portions of the breast cups 20 project above the inner panel 18 where they may be equipped with the usual shoulder straps 22, the major portions of the cups 20 are accommodated within, and project forwardly through, the recesses 17 in the outer panel 16, as will be apparent from FIGS. 1 and 3. Inasmuch as the recesses 17, and consequently the cups 20, are spaced from the lines of stitching 14 and 19, it will be noted that substantially crescent-shaped pockets 23, delineated by stitching lines 14, 19 and 24, exist between the inner and outer panels 18 and 16, respectively, around the lower portions of the breast cups. These pockets 23 thus form spaces beneath the breast cups 20 as shown in an exaggerated manner in FIG. 3, which spaces become closed when the garment is worn and the outer and inner panels 16, 18 come into contact with each other. However, the provision of pockets or spaces 23 avoids a direct physical connection between the outer panel 16 and the inner panel 18 with the breast cups thereon, so that the breast cups 20 mounted to the resilient material comprising the inner panel 18, are quite free to move with the breasts, the cups 20 stretching the inner panel 18 during this movement and thus leaving the outer panel 16 undisturbed.

A pair of substantially U-shaped or semi-circular reinforcing wires 25 are embedded in the edges of the recesses 17 in the outer panel 16 in a manner such that the wires 25 are at all times in the same plane as the outer panel 16 in fixed, non-pivotable relationship thereto. These wires 25 extend along the lower portions and along part of the sides of the breast cups 20, and thus afford support for the underbust. At the same time, the wires 25, being carried by the outer panel 16, are thus detached from the breast cups 20 on the inner panel 18, so that there is what can be termed a free-floating relationship between the wires 25 and the cups 20. This arrangement, together with the provision of the aforementioned pockets or spaces 23 and a resilient inner panel 18, permits the cups 20 to move with the breasts, without disturbing the position of the reinforcing wires 25 relative to the underlying skin of the wearer.

The wires 25 are stituated so as to lie just below the point where the breasts project outward from the body. When located in this manner, the wires 25 can provide underbust support and still be comfortable. Because of the placement of the wires 25 under the breast and the independently movable breast cups 20, the underbust wires 25 can be rigidly attached to the upper edge of the outer panel 16.

Figure 4:
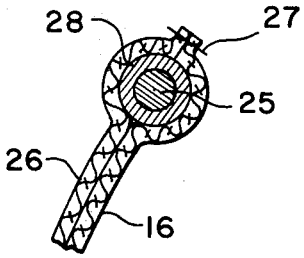
FIG. 4 is an enlarged fragmentary sectional detail showing the mounting of one of the reinforcing wires.

As a practical matter, it is preferred to provide a lining of cushioning material 26 at the inside of the outer panel 16 within the pockets 23, as shown in FIGS. 3 and 4. This lining 26, which can be fabricated of a soft spun polyester material, is secured in place by the stitching 14 at the sides and the stitching 19 along the bottom of the pockets, while along the reinforcing wires 25 the lining 26 may be stitched to the outer panel 16 as indicated, for example, at 27. The lining material 26 can also be wrapped around the wires 25 themselves, as indicated at 28 in FIG. 4, so that the wires 25 are effectively cushioned and the underbust region of the garment is cushioned as well.

While the invention has been described relative to a preferred embodiment of the invention, it will be understood by those skilled in the art that modifications and variations may be effected within the spirit and scope of the invention.

I claim:

1. In a brassiere, a front section, a pair of side sections, and lines of stitching connecting said side sections to opposite side edges of the front section, said front section comprising a fixed outer panel having an upper portion with a pair of transversely spaced substantially semi-circular recesses therein, an elastic inner panel underlying the upper portion of the outer panel, a pair of breast cups provided on the inner panel, lower portions of said cups projecting forwardly through the recesses in the outer panel, a pair of substantially semi-circular reinforcing wires embedded in the edges of the outer panel defining said recesses in fixed, non-pivotable relationship to said outer panel, the sides of said inner panel being connected to said outer panel by said lines of stitching, and the lower edge of said inner panel being secured to the outer panel by further lines of stitching along lines which are spaced downwardly from said recesses so as to define substantially crescent-shaped pockets between the inner and outer panels around the lower portion of said cups, and isolating said breast cups from said reinforcing wires such that the breast cups are in free-floating relationship with respect to said reinforcing wires.

2. The garment as defined in claim 1 further comprising a vertical line of stitching centrally connecting the inner and outer panels together between said breast cups.

3. The garment as defined in claim 1 further comprising a lining of cushioning material provided at the inside of said outer panel within said pockets, said lining enveloping said reinforcing wires at the edges of said recesses.

* * * * *